US005376952A

United States Patent [19]

Kokubo et al.

[11] Patent Number: 5,376,952

[45] Date of Patent: Dec. 27, 1994

[54] DIRECT COLOR THERMAL PRINTING METHOD AND DIRECT COLOR THERMAL PRINTER

[75] Inventors: Hideyuki Kokubo; Hitoshi Saito; Takao Miyazaki; Masamichi Sato, all of Tokyo, Japan

[73] Assignee: Fuji Photo Film Co., Ltd., Kanagawa, Japan

[21] Appl. No.: 911,498

[22] Filed: Sep. 30, 1992

[30] Foreign Application Priority Data

Jul. 10, 1991 [JP] Japan ..... 3-195741

[51] Int. Cl.[5] ..... B41M 5/28; B41M 5/34; B41J 2/32

[52] U.S. Cl. ..... 346/76 PH; 346/76 R; 430/368; 430/142; 430/151; 347/61

[58] Field of Search ..... 430/348, 142, 151; 346/1.1, 76 PH, 76 R

[56] References Cited

U.S. PATENT DOCUMENTS 4,734,704 3/1988 Mizutani et al. ..... 346/76 PH
4,771,032 9/1988 Yamaguchi et al. ..... 503/201

FOREIGN PATENT DOCUMENTS 61-213169 9/1986 Japan .

*Primary Examiner*—Benjamin R. Fuller
*Assistant Examiner*—Huan Tran

[57] ABSTRACT

A direct color thermal printer and method for direct color thermal recording of a full-color image on a thermosensitive color recording material is provided having yellow, magenta and cyan recording layers formed in this order from the outside, by sequentially recording yellow, magenta and cyan frames of the full-color image in this order in yellow, magenta and cyan recording layers. The recording speed of the yellow frame is set higher than the recording speed of the magenta and cyan frames by predetermining a recording cycle of one pixel or a recording time per pixel which is shorter for the yellow recording layer than the recording cycles for the magenta and cyan recording layers.

20 Claims, 5 Drawing Sheets

DIRECT COLOR THERMAL PRINTING METHOD AND DIRECT COLOR THERMAL PRINTER

BACKGROUND OF THE INVENTION

1. Field of the Invention

The present invention relates to a direct color thermal printing method using a thermosensitive color recording material which is colored when heated. The present invention also relates to a direct color thermal printer.

2. Related Art

A thermosensitive color recording material has been suggested, for example, in Japanese Laid-open Patent Application 61-213169, having thermosensitive coloring layers for yellow, magenta and cyan which are laminated or formed on a supporting material in this order from the outside. In this type of recording material, the heat sensitivities of the thermosensitive coloring layers (hereinafter referred to as coloring layers) become lower as the distance from the outside surface increases. Furthermore, the coloring layers have properties that each coloring layer is optically fixed by electromagnetic rays of a respective specific wave length range.

When recording a full-color image on the above-described thermosensitive color recording material, a thermal head having a plurality of heating elements arranged in a line is used. First, the coloring layer for yellow, or the first layer that is disposed on the outermost position of the coloring layers, is thermally recorded, while the thermal head is moved relative to the thermosensitive color recording material. After recording a yellow frame of the full-color image in the first layer in this way, the thermosensitive color recording material is exposed to light having a wave length range by which a diazonium salt compound contained in the first layer is discomposed. Thereby, the first layer is optically fixed by discomposing a part of the diazonium salt compound that still has a capacity for coupling.

Next, a magenta frame of the full-color image is recorded in the coloring layer for magenta, or the second layer that is disposed in the second place from the outside, by using a higher heat energy than that applied for the yellow frame recording. Thereafter, the second layer is optically fixed by being exposed to light having a wave length range that discomposes a diazonium salt compound in the second layer. Then, the highest heat energy is applied to the thermosensitive color recording material, so as to record a cyan frame of a full-color image in the coloring layer for cyan, that is, the third layer disposed at the innermost position of the coloring layers. Finally, light having a wave length range that discomposes a diazonium salt compound, is applied to optically fix the third layer.

It is also known to apply a bias pulse having a relatively large width for heating the thermosensitive color recording material up to a predetermined temperature and then to apply a number of gradation pulses having less than the relatively large width for heating the recording material to the heating element, for recording a pixel in the above-described thermosensitive color recording material, wherein the number of the gradation pulses is determined in accordance with the gradation level of the pixel.

The pulse durations of the bias pulse and the gradation pulse are set larger, when the heat sensitivity of the color layer becomes lower, in order to set a long heating time for the low heat sensitive coloring layer. Therefore, the conventional direct color thermal printing method uses a constant thermal recording speed or a constant recording cycle of one pixel that is adapted to the third layer having the lowest heat sensitivity, for recording in the three coloring layers. As a result, the conventional method has a problem because the total printing time necessary for recording a full-color image is long.

Moreover, because of such a constant recording speed, the cooling time for cooling the heating element within a constant recording cycle of one pixel, changes according not only to the gradation level of each pixel but also according to the heat sensitivity of the coloring layer. Therefore, the cooling time for recording the first layer tends to be longer than the cooling time period for recording the third layer, which is practically redundant. This may make the heating element too cool, so that a lowered efficiency of the heat energy results.

If on the other hand, the heating elements are energized for a longer time by using a lower level electric power, in order to prevent the cooling time period from being too long, the heat energy is transmitted to the second layer while recording the first layer. Thereby, the second layer may be finely colored unnecessarily. The coloring of the unnecessary portion of the second layer causes the reproduction to have an improper tone.

SUMMARY OF THE INVENTION

A primary object of the invention is to provide a direct color thermal printing method by which the total printing time is reduced and three color tones can be properly reproduced.

Another object of the invention is to provide a direct color thermal printer for executing the method of the invention.

To achieve the above objects, according to the invention, the outermost coloring layer of at least three kinds of coloring layers is recorded at a speed higher than the other coloring layers.

According to an embodiment of the invention, the recording speed of the second coloring layer that is disposed below the outermost coloring layer, is higher than the recording speed of the coloring layer that is at the innermost layer.

Because the heat sensitivity of the outermost coloring layer is the highest, the recording time necessary for recording a pixel in the outermost coloring layer is the shortest with respect to recording a pixel of the highest gradation level. Therefore, it is possible to shorten the recording cycle of one pixel in the outermost coloring layer by minimizing the cooling time thereof for the highest gradation level. In this way, the recording speed of the outermost coloring layer can be higher than the recording speed of the other coloring layer.

As a result, the total printing time necessary for recording a full-color image is reduced. Moreover, a waste of time due to the redundant cooling time is eliminated, while the heating elements are prevented from being unnecessarily or exceedingly cooled.

Because the thermosensitive color recording material is not heated for a long time, the heat energy applied for recording a layer is not transmitted to the next layer. Thereby, the next layer is prevented from being finely colored unnecessarily and the reproduction results with a proper tone.

BRIEF DESCRIPTION OF THE DRAWINGS

The above and other objects and advantages of the invention will become apparent from the following detailed description of the preferred embodiments when read in conjunction with the accompanying drawings, wherein.

DETAILED DESCRIPTION OF THE PREFERRED EMBODIMENTS

Figure 1:
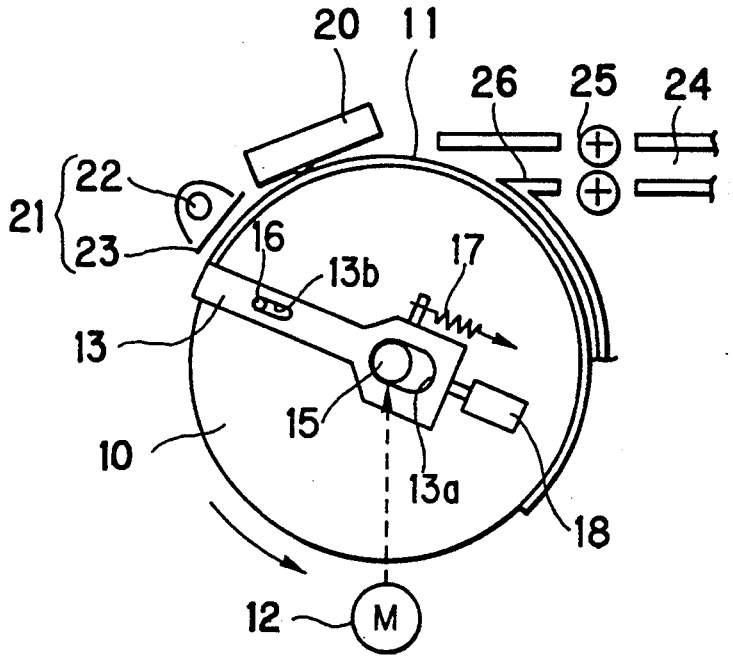
FIG. 1 shows essential elements of a direct color thermal printer according to an embodiment of the invention.

In FIG. 1, a platen drum 10 carries a thermosensitive color recording paper 11 on the outer periphery thereof, and is rotated by a pulse motor 12 in a direction of an arrow during thermal recording. The platen drum 10 is provided with a clamp member 13 which secures the thermosensitive color recording paper 11 to the platen drum 10 at least for a portion, for example, at the leading end of the thermosensitive color recording paper 11.

The clamp member 13 is of a channel shape having a clamp portion extending in an axial direction of the platen drum 10 and arm portions extending in a radial direction of the platen drum 10. Slots 13*a* and 13*b* are formed in either arm portion. The slots 13*a* are engaged with both ends of a platen drum shaft 15, and the slots 13*b* are engaged with guide pins 16 provided on both sides of the platen drum 10. The clamp portion of the clamp member 13 is ordinarily pressed onto the platen drum 10 by a spring 17, and is removed off the platen drum 10 by an act of a solenoid 18 when the thermosensitive color recording paper 11 is to be placed on or displaced from the platen drum 10.

Figure 2:
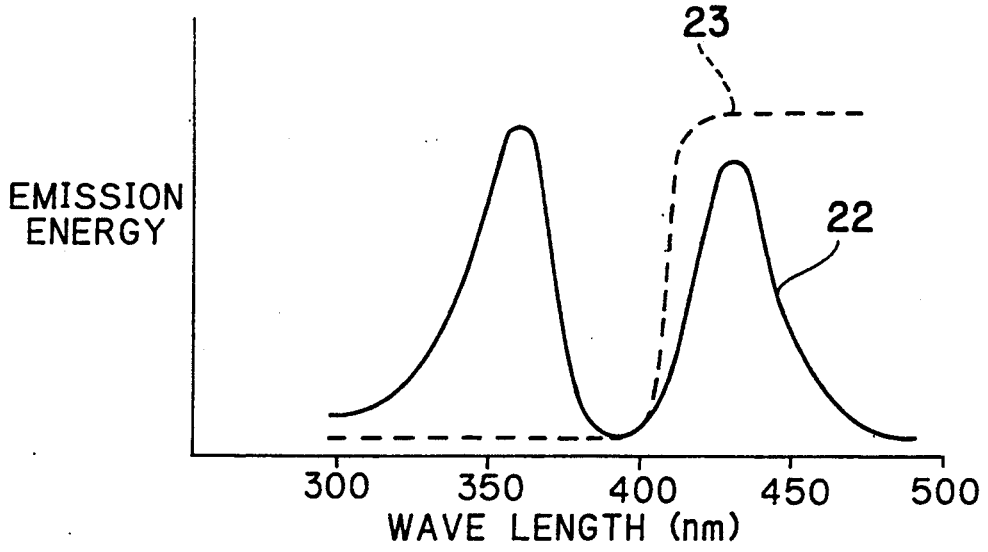
FIG. 2 is a graph showing characteristic curves of an ultraviolet lamp and a sharp-cut filter of an optical fixing device of the direct color thermal printer.

Above the outer periphery of the platen drum 10, a thermal head 20 having a plurality of heating elements arranged in a Line, and an optical fixing device 21 are disposed. The optical fixing device 21 includes a stick-shaped ultraviolet lamp 22 having two emission centers at wave lengths of 365 nm and 420 nm, as shown by solid line curve in FIG. 2, and a sharp-cut filter 23 having a transmission curve as shown by dashed line in FIG. 2. The sharp-cut filter 23 is placed on the front of the ultraviolet lamp 22 by means of a solenoid or another device, so as to transmit near ultraviolet rays having a wave length range of about 420 nm.

A paper feed path 24 is provided with a pair of feed rollers 25 through which the thermosensitive color recording paper 11 is fed to the platen drum 10 and, thereafter, is ejected from the platen drum 10. Downstream of the paper feed path 24, that is, on the side near to the platen drum 10, a peeling member 26 is provided for peeling off the trailing end of the thermosensitive color recording paper 11 from the platen drum 10 and guiding the thermosensitive color recording paper 11 to the paper feed path 24 for ejecting the thermosensitive color recording paper 11.

Although the paper feed path 24 is commonly used for paper feeding and ejecting, it is possible to provide a paper ejection path separately from a paper feed path.

Figure 3:
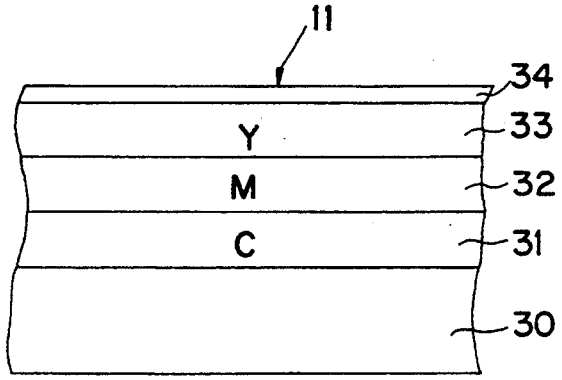
FIG. 3 is an explanatory view of the construction of a thermosensitive color recording material.
Figure 4:
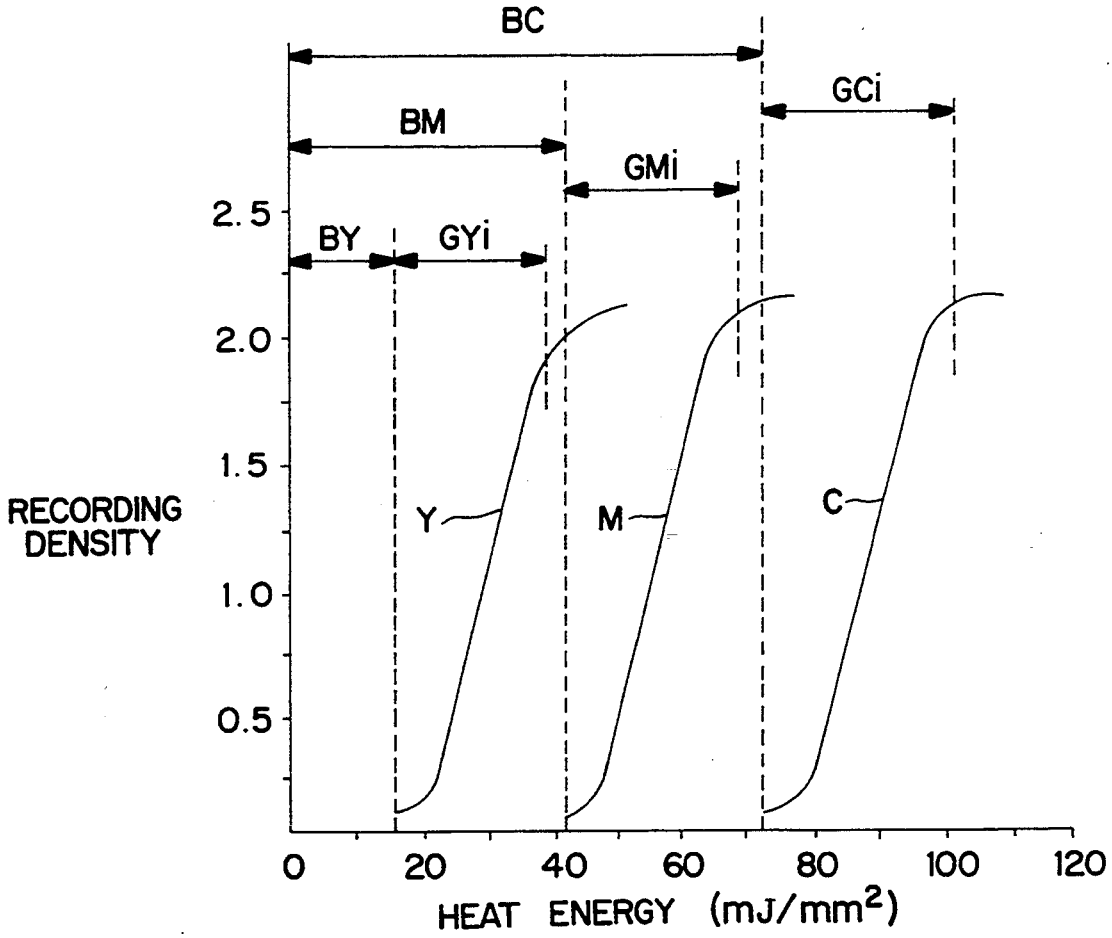
FIG. 4 is a graph showing color developing characteristics of the respective coloring layers of the thermosensitive color recording material.

FIG. 3 shows an example of the thermosensitive color recording paper 11, wherein a cyan recording layer 31, a magenta recording layer 32, a yellow recording layer 33 and a protective layer 34 are formed on a supporting material 30 in this order from the inside. Practically, intermediate layers are provided between the respective layers, but are not shown for clarity. As shown in FIG. 4, a heat energy range GY for recording the yellow recording layer 33 is the lowest, and a heat energy range GC for recording the cyan recording layer 31 is the highest.

When recording a yellow pixel, a constant bias heat energy BY and a variable gradation heat energy GYi are applied to the thermosensitive color recording paper 11. The value of the variable gradation heat energy GYi depends on the gradation level I of the yellow pixel, and the constant bias heat energy has a value for heating the thermosensitive color recording paper 11 up to a temperature over which the yellow recording layer 35 starts to be colored.

In the same way, a magenta pixel is recorded by applying a constant bias heat energy BM and a gradation heat energy GMi which varies depending on the gradation of the magenta pixel. A cyan pixel is recorded by applying a constant bias heat energy BC and a gradation heat energy GCi which varies depending on the gradation of the cyan pixel.

As seen from FIG. 4, because the cyan recording layer 31 has a heat sensitivity lower than the other two color recording layers 32 and 33, it is necessary to apply a large amount of bias heat energy by performing the bias heating for a long time. On the other hand, the yellow recording layer 33 needs a small bias heat energy, so that the bias heating can be performed for a short time. Therefore, the present embodiment uses a snorter recording time period per pixel for the yellow recording layer 33 that has the highest heat sensitivity, than the recording time periods for the other color recording layers 31 and 32. As a result, the total printing time becomes shorter than the conventional printing method, wherein a constant recording time period per pixel is used for any color recording layer, without reducing the color reproduction quality.

Figure 5:
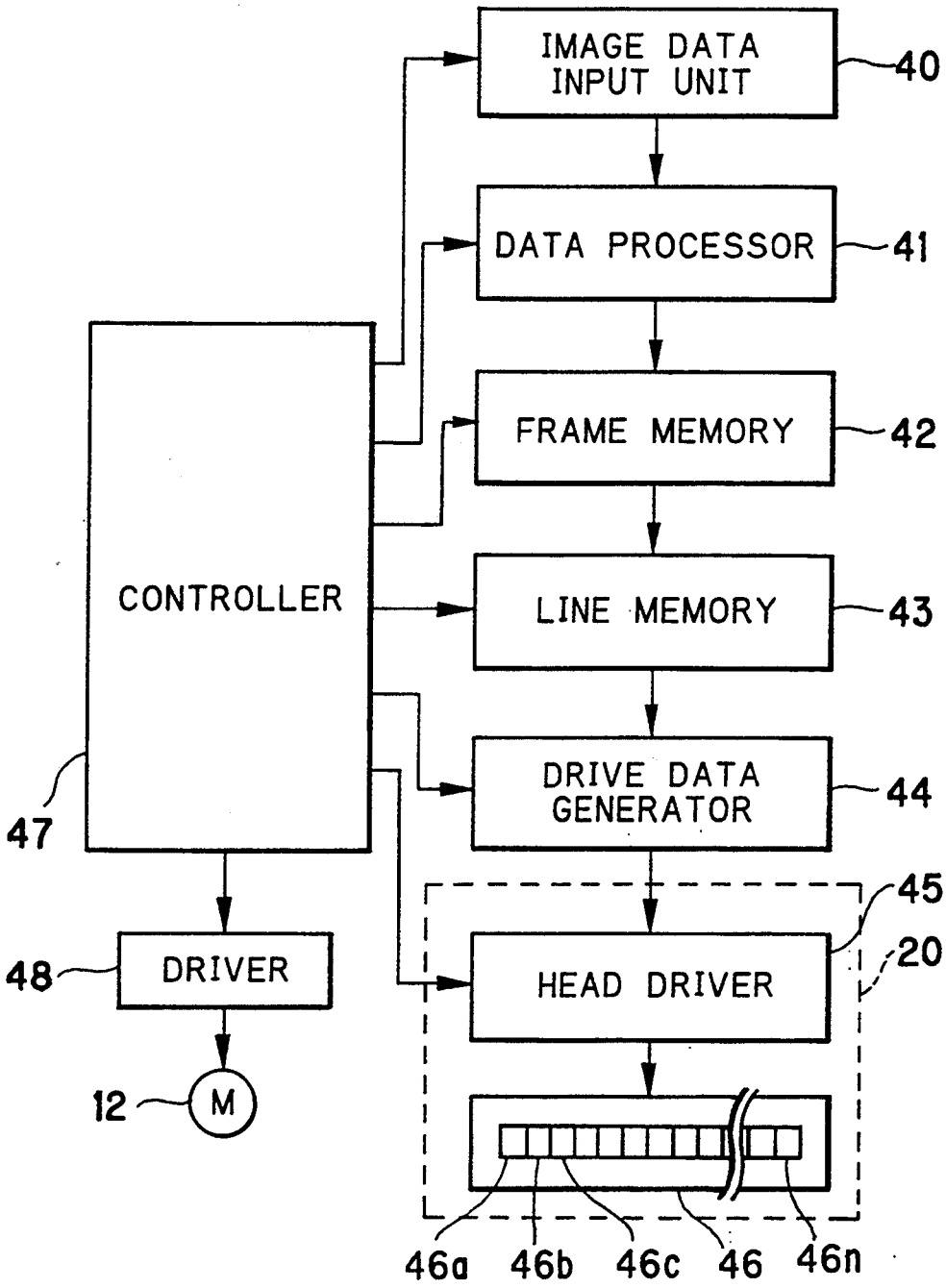
FIG. 5 is a block diagram showing the circuitry of the direct color thermal printer.

FIG. 5 shows the circuitry of a direct color thermal printer embodying the present invention, wherein an image data input unit 40, which is a color scanner, a color television camera or the like, for instance, detects image data of red, green and blue colors and sends the three color image data to a data processor 41. The data processor 41 performs color and density correction and other operations onto the respective three color image data.

The processed image data are sent to a frame memory 42 to be stored therein separately for each color. In thermal recording, the image data are read out for each color and line by line from the frame memory 42, and are written in a line memory 43.

The image data of one line read out from the line memory 43 are sent to a drive data generator 44 to be converted into drive data for the respective pixels of one line. The drive data include bias drive data for the bias heating, and gradation drive data for generating an amount of gradation heat energy. The drive data of one line are sent to a head driver 45, which converts the drive data into a bias pulse and a number of gradation pulses for each pixel, the number of the gradation pulses corresponding to the gradation level of each pixel.

The bias pulse and the gradation pulses are supplied to each of a plurality of heating elements 46*a* to 46*n* of the heating section 46. The heating elements 46*a* to 46*n* are arranged in a line in a main scan direction, and are moved relative to the thermosensitive color recording paper 11 in a subsidiary scan direction. A controller 47 sequentially controls the above-described electric elements of the thermal printer, and also controls the pulse motor 12 through a drive 48, so as to rotate the pulse motor 12 at a higher speed, as the heat sensitivity of the color recording layer becomes higher.

Figure 6:
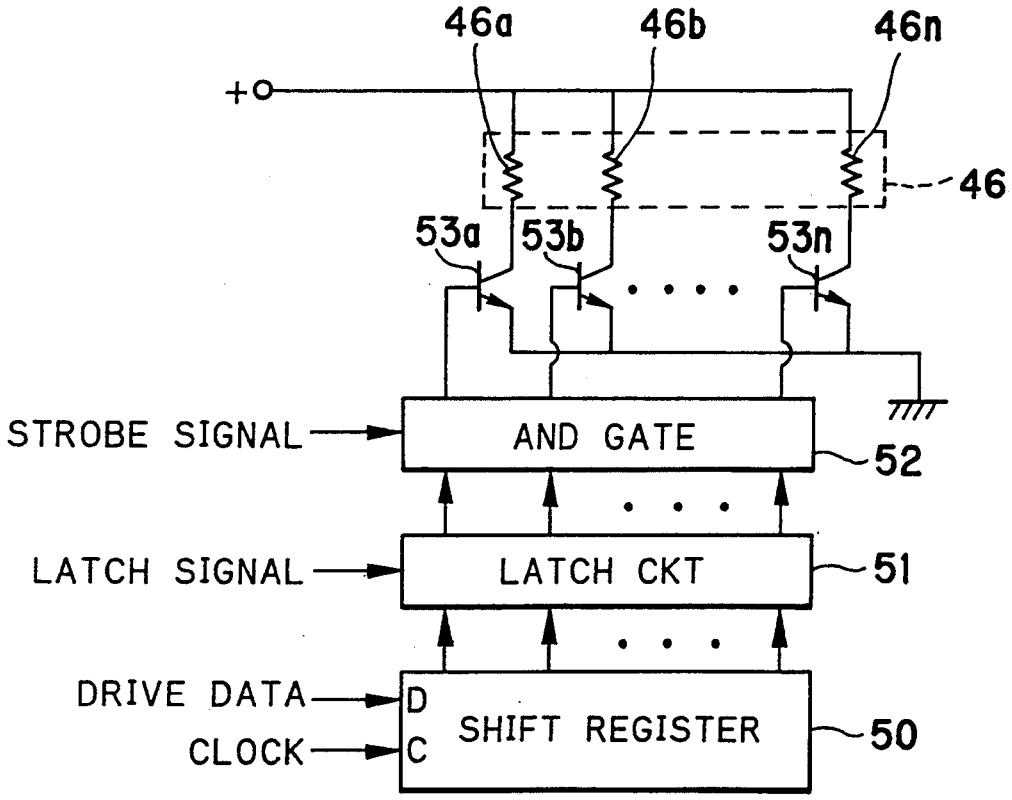
FIG. 6 is a circuit diagram of the head driver and the heating section.

The drive data of one line are generated as follows: First, the bias drive data having a high (H) level are allocated to every pixel of one line, which are serially sent to a shift register 50 of the head driver 45, at a timing of a clock signal, as shown in FIG. 6. The shift register 50 converts the serial bias drive data into parallel bias drive data. The parallel bias drive data in the shift register 50 are latched in a latch circuit 51 at a timing of a latch signal. An AND gate 52 outputs a signal of a high (H) level from one of a plurality of parallel outputs thereof if the latched data corresponding to that output has the H level, each time a strobe signal is inputted to the AND gate 52.

The parallel outputs of the AND gate 52 are connected to transistors 53*a* to 53*n* in one to one relation, each of which is turned on when the corresponding output of the AND gate 52 becomes an H level. When any one of the transistors 53*a* to 53*n* is turned on, the corresponding one of the heating elements 46*a* to 46*n* that is connected to that transistor is energized.

After applying the bias drive data to the shift register 50, the drive data generator 44 compares the image data with first reference data indicative of a first predetermined gradation level, for determining whether a pixel of one line is to be recorded at the first gradation level or more. If the pixel of one line is to be recorded at the first gradation level or more, a high (H) level signal is generated. If the pixel of one line is not to be recorded at the first gradation level or more, a low (L) level signal is generated.

This comparison is performed for every pixel of one line, so that drive data allocated to every pixel of one line is serially outputted to the shift register 50. The heating elements 46*a* to 46*n* are selectively driven by the serial drive data, in a manner as described above. In the same way as for the first gradation level, the image data of one line are compared with a second predetermined reference data, for determining whether the respective pixels of one line are to be recorded at the second gradation level or more.

In this way, the drive data of one line are generated from the drive data generator 44, while being split in 65 steps, inclusive of the bias drive pulse, assuming that the gradation level of each pixel has 64 steps. Therefore, the heating elements 46*a* to 46*n* are driven by the bias drive pulse and, thereafter, selectively driven by the 1 to 64 gradation drive pulses, while 65 strobe signals are applied to the AND gate 52. As a result, a line of pixels having 64 gradation levels are recorded.

Figure 7:
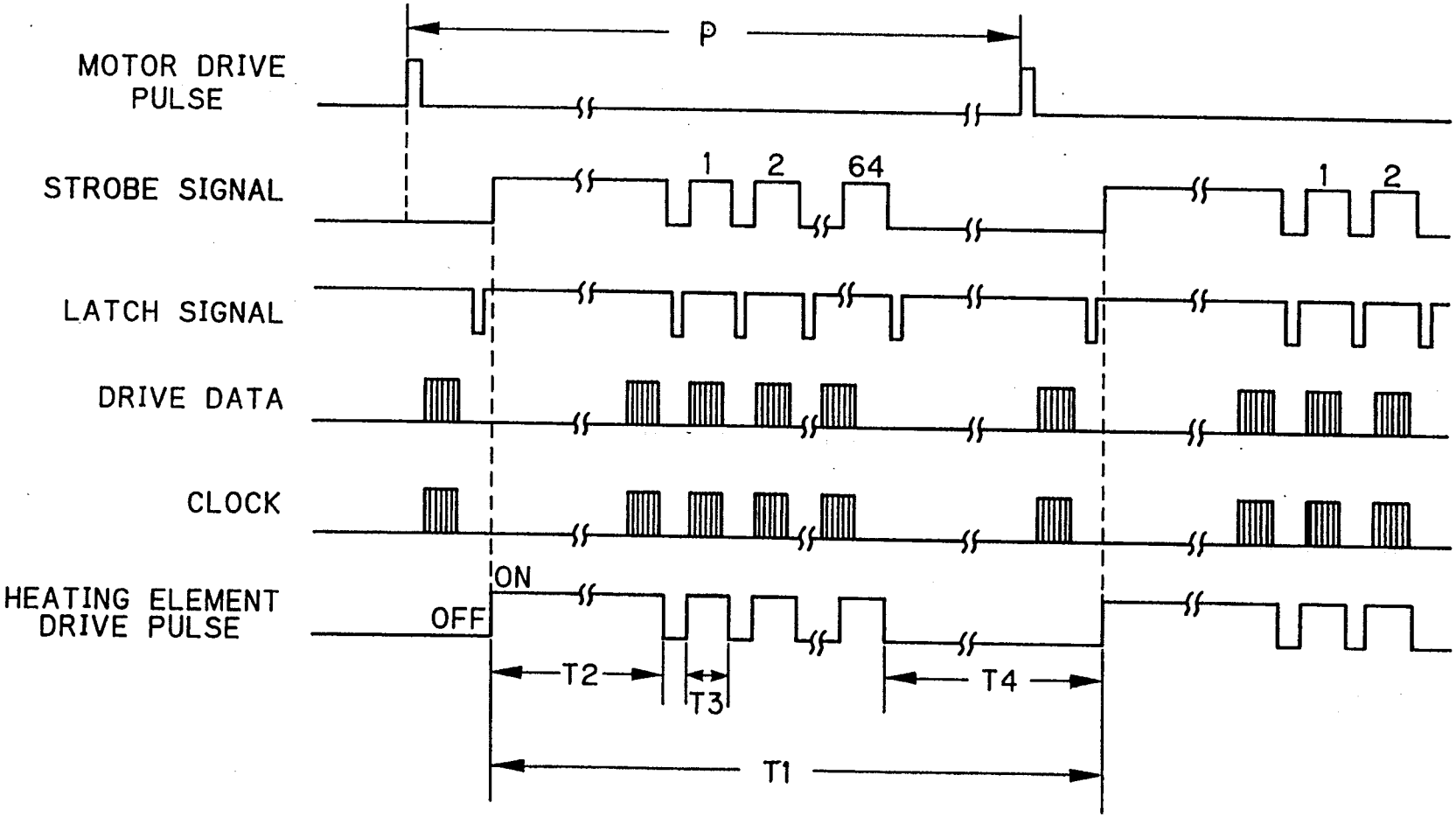
FIG. 7 show time charts of signals applied to the head driver.

FIG. 7 shows timing charts of the above-described signals, wherein P represents a motor drive pulse and T1 represents a recording cycle allocated from recording one pixel which is set shorter for the color recording layer having a higher heat sensitivity. T2 represents a pulse duration of the bias drive pulse for bias heating, which is set smaller for the color recording layer having a higher heat sensitivity. T3 represent a pulse duration of one gradation pulse which is set smaller for the color recording layer having a higher heat sensitivity. These pulse durations T2 and T3 are determined by the pulse duration of the strobe signal. T4 represents a cooling time period which varies depending on the gradation level and the heat sensitivity of the color recording layer. Consequently, the recording time period T1 for each of the recording layers consists of the bias heating time and a gradation heating time necessary for reproducing the highest gradation level of the 64 steps, and a minimum cooling time necessary for cooling the heating elements after they are driven for recording the highest gradation level.

Next, the operation of the above-described direct color thermal printer will be described.

For printing a full-color image, the image data of the three colors entered through the image data input unit 40 are written in the frame memory 42 separately for each color, after being processed in the image processor 41. During paper feeding, the platen drum 10 stays in a position where the clamp member 13 is placed at the exit of the paper feed path 24 with its arm portions oriented vertically as shown in FIG. 1.

When the solenoid 18 is energized, the clamp member 13 is set to a clamp release position where the clamp portion thereof is removed off from the platen drum 10. The pair of feed rollers 25 nip and feed the thermosensitive color recording paper 11 toward the platen drum 10. The feed rollers 25 stop rotating when the leading end of the thermosensitive color recording paper 11 is placed between the platen drum 10 and the clamp member 13. Thereafter when the solenoid 18 is turned off, the clamp member 13 is returned to the initial position according to the act of the spring 17, thereby clamping the leading end of the thermosensitive color recording paper 11. After clamping the thermosensitive color recording paper 11, the platen drum 10 and the feed rollers 25 start rotating, so that the thermosensitive color recording paper 11 is wound on the outer periphery of the platen drum 10.

The platen drum 10 is rotated intermittently by a predetermined step. When a leading edge of a recording area of the thermosensitive color recording paper 11 reaches the thermal head 20, the recording of a yellow frame of the full-color image is started. During the yellow frame recording, because the bias heating time may be the shortest, the pulse motor 12 rotates at the highest speed.

The image data of one line of the yellow frame are read out from the frame memory 42, and are temporarily written in the line memory 43. Then, the image data are read out from the line memory 43, and are sent to the drive data generator 44. The drive data generator 44 outputs the signals shown in FIG. 7 to the head driver 45. The head driver 45 drives the heating elements 46*a* to 46*n*, so as to apply the bias heat energy BY and the gradation heat energy GYi that depends on the image data, to the thermosensitive color recording paper 11. As a result, the yellow recording layer 33 is colored at a desirable density for each pixel.

When the recording of the first line of the yellow frame is completed, the platen drum 10 is rotated by the pulse motor 12 by an amount corresponding to one pixel. Simultaneously, the image data of the second line of the yellow frame are read out from the frame memory 42. Thereafter, the same procedure as above is repeated for recording the second and the following lines of the yellow frame.

The part of the recording paper 11 on which the yellow frame is recorded is moved under the optical fixing device 21, and the yellow recording layer 33 is optically fixed. At that time, because the sharp-cut filter 23 is placed in front of the ultraviolet lamp 22, the recording paper 11 is exposed to near ultraviolet rays having a wave length range of about 420 nm, so that the diazonium salt compound remaining in the yellow recording layer 33 is optically discomposed to lose the coupling capacity thereof.

When the platen drum 10 makes one revolution to place the leading edge of the recording area again under the thermal head 20, a magenta frame of the full-color image begins to be recorded line by line. During the magenta frame recording, the bias heat energy BM and the gradation heat energy GMi that depends on the image data are applied to the recording paper 11, while the pulse motor 12 is rotated at a middle speed. Although the heat energy applied for coloring the magenta recording layer 32 is larger than the heat energy for coloring the yellow recording layer 33, the yellow recording layer 33 is not colored because it has already been optically fixed.

The magenta recording layer 32 having the magenta frame recorded therein is optically fixed by means of the optical fixing device 21. For the magenta recording layer fixing, the sharp-cut filter 23 is displaced from the front of the ultraviolet lamp 22, so that the recording paper 11 is exposed to all of the electromagnetic rays radiated from the ultraviolet lamp 22. Among these electromagnetic rays, ultraviolet rays having a wave length range of about 365 nm optically fix the magenta recording layer 32.

When the platen drum 10 further makes one revolution so as to place the recording area under the thermal head once again, recording of a cyan frame of the full-color image is started. Because the necessary bias heating time for the cyan frame recording is longer than the other two color frames, the pulse motor 12 is rotated at a lower speed during the cyan frame recording than the recording speeds for the other color frames. The thermal head 20 applies the bias heat energy BC and the gradation heat energy GCi that depends on the image data to the recording paper 11, for recording the cyan frame line by line in the cyan recording layer 31.

The heat energy necessary for coloring the cyan recording layer 31 has such a large value that cannot be applied to the recording paper under a normal keeping condition. Therefore, the cyan recording layer 31 is not given a capacity of being optically fixed. For this reason, the optical fixing device 21 is turned off in the cyan frame recording.

Although the present embodiment uses a single ultraviolet lamp in combination with a sharp-cut filter, it is, of course, possible to provide two optical fixing devices for yellow and magenta which radiate electromagnetic rays having wave lengths of 420 nm and 365 nm, respectively.

After recording the yellow, magenta and cyan frames of the full-color imaging, the platen drum 10 and the feed rollers 25 are rotated reversely. Thereby, the trailing end of the recording paper 11 is guided by the separation claw 26 into the paper feed path 24, and is nipped by the feed rollers 25. Thereafter when the platen drum 10 reaches the initial position at which the clamp member 13 is placed at the exit of the paper feed path 24, the solenoid 18 is turned on, and simultaneously the platen drum 10 stops rotating.

When the solenoid 18 is turned on, the clamp member 13 is moved to the clamp release position against the act of the spring 17, so that the leading end of the recording paper 11 is released from the clamp member 13, and is ejected from the platen drum 10 through the paper feed path 24.

For easy understanding of the invention, numerical values used in experiments are shown in Table 1. It is to be noted that a thermal head was used as the thermal head 20 in the experiments, having a dot density of 9.45 dots/mm in the main scan direction, a line density of 7 lines/mm and a resistance for the heating elements of 2710Ω. In the Table 1, T4 indicates the minimum cooling time after the recording of a pixel of the highest gradation level.

TABLE 1

| | yellow | magenta | cyan |
|---|---|---|---|
| bias pulse T2 (ms) | 1.7 | 3.9 | 8.3 |
| gradation pulse T3 (ms) | 0.064 | 0.081 | 0.103 |
| (duty factor %) | 84 | 86 | 90 |
| cooling time T4 (ms) | 10 | 10 | 10 |
| line recording speed (mm/s) | 6.35 | 5.32 | 4.11 |
| voltage applied to the thermal head (V) | 20 | 20 | 20 |

Although the above-described embodiment only relates to a line printer wherein a plurality of heating elements are arranged in the main scan direction, and the recording paper is moved linearly relative to the thermal head in the subsidiary scan direction, the present invention is applicable to serial printers wherein pixels are serially printed by a two-dimensional movement of the recording paper relative to the thermal head.

Furthermore, the order of lamination of the color recording layers on the supporting layer is not limited to the above-described embodiment, but may be changed appropriately. In that case, it is unnecessary to provide the innermost color recording layer with the capacity of being optically fixed. Of course, it is possible to provide that capacity to the innermost color recording layer.

It is to be noted that in the conventional thermal transfer recording, such as thermal wax transfer recording and thermal dye transfer or sublimation-type thermal transfer recording, the recording speeds for the three or four colors are set at a same value. Indeed the recording speeds may be slightly different from each other in the thermal dye transfer recording because conversion table data of each color are set suitably for each color, so as to control the gradation of each color individually, but such a difference is so small that the recording speed for each color can be regarded as substantially equal. On the contrary, according to the present invention, the difference between the recording speeds reach several tens percents which are obviously a remarkable difference. Moreover, as seen from the above-recited data, the printing time is remarkably reduced.

Although the present invention has been described with reference to the embodiment shown in the drawings, the invention should not be limited by the embodiment but, on the contrary, various modifications of the present invention can be effected without departing from the spirit and scope of the appended claims.

What is claimed is:

1. A direct color thermal printing method for recording a full-color image on a thermosensitive color recording material having at least a first thermosensitive recording layer formed inside an outermost layer, a second thermosensitive recording layer formed inside said first thermosensitive recording layer and a third thermosensitive recording layer formed inside said second thermosensitive recording layer at an innermost layer, by using a thermal head having a plurality of heating elements arranged in a line which is moved relative to said thermosensitive color recording material, wherein each of the first, second and third thermosensitive recording layers independently has a capacity to develop a different color, and the first thermosensitive recording layer inside the outermost layer has a first high heat sensitivity, the second thermosensitive recording layer has a second heat sensitivity lower than said first high heat sensitivity and the third thermosensitive recording layer at the innermost layer has a third heat sensitivity lower than said first high heat sensitivity and said second heat sensitivity, said method comprising the steps of:

(a) thermally recording a first color frame of the full-color image in the first thermosensitive recording layer at a first speed;

(b) optically fixing the first thermosensitive recording layer by exposing said thermosensitive color recording material to electromagnetic rays of a first predetermined wave length range for the first thermosensitive recording layer;

(c) thermally recording a second color frame of the full-color image in the second thermosensitive recording layer at a second speed lower than said first speed;

(d) optically fixing the second thermosensitive recording layer by exposing said thermosensitive color recording material to electromagnetic rays of a second predetermined wave length range for the second thermosensitive recording layer; and (e) thermally recording a third color frame of the full-color image in the third thermosensitive recording layer at a third speed lower than said first speed.

2. A direct color thermal printing method as recited in claim 1, wherein said second speed is higher than said third speed.

3. A direct color thermal printing method as recited in claim 2, wherein said first, second and third speeds are determined such that a recording cycle allocated to one pixel in each of said first, second and third thermosensitive recording layers is minimized.

4. A direct color thermal printing method as recited in claim 3, wherein said recording cycle comprises the step of heating said thermosensitive color recording material by a constant bias heating time up to a temperature that is determined depending on the heat sensitivity of each of said first, second and third thermosensitive recording layers, a gradation heating time that is variable according to a gradation level of each pixel and the heat sensitivity of each of said first, second and third thermosensitive recording layers, and first, second and third cooling times corresponding to said first, second and third thermosensitive recording layers respectively for cooling said heating elements.

5. A direct color thermal printing method as recited in claim 4, wherein said recording cycle is determined such that said first, second and third cooling times are optimized for each of said first, second and third thermosensitive recording layers.

6. A direct color thermal printing method as recited in claim 5, wherein said first cooling time for said first thermosensitive recording layer is determined to be equal to said second or third cooling time for said second or said third layer when a pixel of a predetermined highest gradation level is recorded.

7. A direct color thermal printing method as recited in claim 1, further comprising the steps of:

(f) disposing said thermosensitive color recording material on an outer periphery of a platen drum;

(g) rotating said platen drum, so as to move said thermosensitive color recording material relative to said thermal head; and (h) controlling a rotation of said platen drum at said step (g) for moving said thermosensitive color recording material selectively at said first, second or third speed.

8. A direct color thermal printer for recording a full-color image on a thermosensitive recording layer formed inside an outermost layer, a second thermosensitive recording layer formed inside said first thermosensitive recording layer and a third thermosensitive recording layer formed inside said second thermosensitive recording layer at an innermost layer, each of the first, second and third thermosensitive recording layers independently having a capacity to develop a different color, wherein the first thermosensitive recording layer that is inside the outermost layer has a first high heat sensitivity, the second thermosensitive recording layer has a second heat sensitivity lower than said first high heat sensitivity and the third thermosensitive recording layer at the innermost layer has a third heat sensitivity lower than said first high heat sensitivity and said second heat sensitivity, said printer comprising:

a thermal head having a plurality of heating elements arranged in a line in a primary scan direction which is moved relative to said thermosensitive color recording material; and controlling means for controlling a speed of recording in each of said first, second and third thermosensitive recording layer such that first recording speed for said first thermosensitive recording layer is higher than second and third recording speeds for said second and third thermosensitive recording layers.

9. A direct color thermal printer as recited in claim 8, wherein said second recording speed is higher than said third recording speed.

10. A direct color thermal printer as recited in claim 8, further comprising a scanner for moving said thermal head or said thermosensitive color recording material in a subsidiary scan direction which is perpendicular to said primary scan direction, wherein said controlling means controls said scanning means to move at one of said first, second and third recording speeds.

11. A direct color thermal printer as recited in claim 8, wherein said scanner includes a platen drum on which said thermosensitive color recording material is wound, and a pulse motor for rotating said platen drum.

12. A direct color thermal printer as recited in claim 8, wherein said first, second and third recording speeds are determined such that a recording cycle associated with one pixel recorded in each of said first, second and third thermosensitive recording layers is minimized.

13. A direct color thermal printer as recited in claim 12, wherein said recording cycle is minimized by determining a cooling time for cooling each of said plurality of heating elements to be optimum for each of said first, second and third thermosensitive recording layers, said cooling time being included in said recording time.

14. A direct color thermal printer system for recording a full-color image, comprising:

a thermosensitive color recording material having at least a first thermosensitive recording layer formed inside an outermost layer, a second thermosensitive recording layer formed inside said first thermosensitive recording layer and a third thermosensitive recording layer formed inside said second thermosensitive recording layer at an innermost layer for recording the full-color image thereon, each of said first, second and third thermosensitive layers independently having a capacity to develop a different color and said first thermosensitive recording layer inside said outermost layer has a first heat sensitivity, said second thermosensitive recording layer has a second heat sensitivity lower than said first heat sensitivity and said third thermosensitive recording layer at the innermost layer has a third heat sensitivity lower than said first and second heat sensitivities;

a thermal head having a plurality of heating elements arranged in a line in a primary scan direction which is positioned over and is moved relative to said thermosensitive color recording material; and a controller operatively connected to said thermal head for controlling a speed of recording and an exposure of electromagnetic rays to said first, second and third thermosensitive recording layers such that a first recording speed for said first thermosensitive recording layer is higher than second and third recording speeds for said second and third thermosensitive recording layers.

15. A direct color thermal printer system as recited in claim 14, wherein said controller further comprises:

thermal recording means for controlling the thermal recording for a first color frame of the full-color image in said first thermosensitive recording layer at said first recording speed, a second color frame of the full-color image in said second thermosensitive recording layer at said second recording speed and a third color frame of the full-color image in said third thermosensitive recording layer at said third recovering speed; and optical fixing means for optically fixing said first thermosensitive recording layer by exposing said thermosensitive color recording material to electromagnetic rays of a first predetermined wave length range and said second thermosensitive recording layer by exposing said thermosensitive color recording material to electromagnetic rays of a second predetermined wave length range.

16. A direct color thermal printer system as recited in claim 14, wherein said second recording speed is higher than said third recording speed.

17. A direct color thermal printer system as recited in claim 14, further comprising a scanner for moving said thermal head or said thermosensitive color recording material in a subsidiary scan direction which is perpendicular to said primary scan direction, wherein said controller controls said scanner to move at one of said first, second and third recording speeds.

18. A direct color thermal printer system as recited in claim 14, wherein said scanner includes a platen drum on which said thermosensitive color recording material is wound and a pulse motor for rotating said platen drum.

19. A direct color thermal printer system as recited in claim 14, wherein said first, second and third recording speeds are determined such that a recording cycle associated with one pixel recorded in each of said first, second and third recording layers is minimized.

20. A direct color thermal printer system as recited in claim 19, wherein said recording cycle is minimized by determining a cooling time for cooling each of said plurality of heating elements to be optimum for each of said first, second and third thermosensitive recording layers, said cooling time being included in said recording cycle.

* * * * *